US005617789A

United States Patent [19]

Achelpohl et al.

[11] Patent Number: 5,617,789

[45] Date of Patent: Apr. 8, 1997

[54] PRINTING PRESS WITH CANTILEVERED ROLLS SIDE MOUNTED ON A RETRACTABLE ACCESS PLATE

[75] Inventors: Fritz Achelpohl, Lienen; Uwe Rogge, Lengerich; Alois Thöle, Lienen; Rainer Jendroska, Greven, all of Germany

[73] Assignee: Windmöller & Hölscher, Lengerich/Westf., Germany

[21] Appl. No.: 634,520

[22] Filed: Apr. 18, 1996

[30] Foreign Application Priority Data

May 2, 1995 [DE] Germany ..... 195 16 004.5

[51] Int. Cl.[6] ..... B41F 5/00

[52] U.S. Cl. ..... 101/216; 101/247

[58] Field of Search ..... 101/216, 139, 101/146, 184, 185, 247, 479, 200

[56] References Cited

U.S. PATENT DOCUMENTS

| | | | |
|---|---|---|---|
| 2,460,504 | 2/1949 | Huebner | 101/216 |
| 4,913,048 | 4/1990 | Tittgemeyer | 101/216 |
| 5,060,569 | 10/1991 | Gladow | 101/216 |
| 5,101,726 | 4/1992 | Lübre et al. | 101/216 |
| 5,237,920 | 8/1993 | Guaraldi | 101/216 |
| 5,241,905 | 9/1993 | Guaraldi et al. | 101/216 |
| 5,458,061 | 10/1995 | Koura et al. | 101/216 |
| 5,471,929 | 12/1995 | Rogge et al. | 101/247 |
| 5,522,316 | 6/1996 | Singler | 101/479 |

FOREIGN PATENT DOCUMENTS

| | | | |
|---|---|---|---|
| 1080945 | 12/1954 | France | 101/216 |
| 9208449 | 10/1992 | Germany . | |
| 9208023 | 1/1993 | Germany . | |

*Primary Examiner*—Eugene H. Eickholt
*Attorney, Agent, or Firm*—Keck, Mahin & Cate

[57] ABSTRACT

A printing press is provided with at least one counterpressure cylinder and with at least one printing roller cantilevered at one end in the rolling stand and at least one inking roller or screen roller of an inking system cantilevered at one end in the rolling stand, where the bearings of the printing roller and screen roller travel, in guide mechanisms, relative to the counterpressure cylinder. In order to ensure that the printing executed by means of the end region of the cantilevered impression cylinder is also perfect, a plate is coupled to the rolling stand, which plate is provided with bearings in order to accommodate the journals of the free ends of the printing and screen rollers. In this regard, the plate can be swung to either a retracted position, in which the cantilevered rollers are freely accessible, or to a operating position, where the journals of the free ends of the rollers are carried by the plate.

15 Claims, 4 Drawing Sheets

56
26
1
26
12
57
26

38
37
42
41
44
51
53
50
12
3
16
52
9
11
15
2
14
8
10
13
1

PRINTING PRESS WITH CANTILEVERED ROLLS SIDE MOUNTED ON A RETRACTABLE ACCESS PLATE

FIELD OF THE INVENTION

The invention pertains to a printing press, preferably a flexographic printing press, with at least one counterpressure cylinder and with at least one impression cylinder cantilevered at one end in the rolling stand and at least one inking roller or screen roller of an inking system cantilevered at one end in the rolling stand, where the bearings of the form cylinder and screen roller travel, in guide mechanisms, relative to the impression cylinder.

BACKGROUND OF THE INVENTION

A printing press of this type is known from DE-GM 9,208,023. Cylinders cantilevered at one end form spring-mass systems which tend to vibrate. For this reason, it is known from DE-GM 9,208,449, for a printing press of the aforementioned type, to damp the vibration of the cylinders mounted at one end by placing a ring on the free end region of the impression cylinder, the diameter of which ring corresponds to the diameter of the external cylinder described by the block. Placement of this ring on one end of the impression cylinder ensures that the former is supported by the counterpressure cylinder and screen roller or, in other words, rolls between the two, such that the free end of the impression cylinder is also damped between the impression cylinder and the screen roller. Although this known arrangement has already led to a considerable damping and suppression of the vibration of cantilevered cylinders, the printing executed by the end region of the impression cylinder is not optimal in all cases.

SUMMARY OF THE INVENTION

For this reason, the purpose of the invention is to create a printing press of the aforementioned type, for which the printing executed by the end region of the cantilevered impression cylinder is also perfect.

This problem is solved according to the invention for a printing press of the aforementioned type by coupling a carrier or plate to the rolling stand, which plates are provided with bearings in order to accommodate the journals of the free ends of the printing and screen rollers or are provided with receivers for bearings placed on the journals and in that the plate can be swung to either a retracted position, in which the cantilevered rollers are freely accessible, or to a position for use, where the journals of the free ends of the rollers are carried by the plate. For the printing press according to the invention, additional bearings are provided on the hinged plate, which bearings support the free ends of the cantilevered rollers and, in this way, absorb undesired vibration of the free ends of the cantilevered rollers and deflection which could impair printing quality. The bearings, which serve merely to support the free ends of the cantilevered cylinders, which bearings are fundamentally auxiliary arrangements of bearings for preventing vibration and undesired deflection, can be quickly and easily removed by swinging over the plate, such that the cantilevered rollers are accessible from the outside and the impression cylinder sleeves can be exchanged easily and quickly. By swinging the plate into the operating position, the free ends of the cylinders are again supported by bearings.

The impression cylinder sleeves which carry the impression cylinders with exchangeable blocks can be conventional block cylinders and format cylinders or form cylinders.

For the printing press according to the invention, primary bearings are still provided on one side of the cylinder, which bearings are responsible for cantilevering the latter. In essence, the arrangements of bearings provided according to the invention on the hinged plate are only auxiliary arrangements of bearings which serve to support the ends of the cantilevered rollers.

An additional configuration of the invention provides for the journals of the free ends of the cantilevered rollers, or the bearings placed on the latter, to be held between a limit stop of the plate and a movable abutment which travels toward the latter. In this way, after the plate has been swung into the operating position, the arrangement of bearings of the free ends of the rollers or, in other words, a support of the bearings placed on these free ends can be effected easily and quickly.

The primary bearings of the cantilever arrangements of the printing roller and screen roller are movable in order to adjust the printing roller to the counterpressure cylinder and the screen roller to the printing roller and to be able to make each roller travel alone and, if necessary, together relative to the counterpressure cylinder. For this purpose, one end of the printing roller can be cantilevered on a first movable slide which is guided in a guide mechanism fixed to the rolling stand and one end of the screen roller can be cantilevered on a second movable slide guided in a slide mechanism of the first slide. This type of cantilever arrangement of a roll which travels relative to the counterpressure cylinder is known, e.g., from DE 4,308,711 A1.

Therefore, since the primary bearings of the rolls travel individually and also both together, relative to the counterpressure cylinder, the bearings which support the free ends of the rollers must also be able to travel and slide in the same direction as the primary bearings. In an additional configuration of the invention, each of the limit stops can be adjusted, for this reason, parallel to the slide mechanisms of the primary bearings.

Each of the limit stops can be fastened to a rod assembly which is slidable in guide mechanisms, which rod assembly is equipped with a fine-tuning control. Here, the fine-tuning control allows adjustments to be made to the free ends of the rollers, if this should be required for quality printing.

The fine-tuning control can be composed of a spindle drive.

An additional configuration of the invention provides for the driving gear of the spindle drive to be adjustable at the plate in the longitudinal direction of the spindle and to be fixable on the plate. This configuration enables the supports, which support the free ends of the rollers to be adjusted in the same quick manner as the primary arrangements of bearings, if this should be necessary, e.g., in order to move the printing roller to the printing off position.

The plate can be provided with an elongated hole parallel to the spindle or rod assembly, through which elongated hole passes a stud which carries the driving gear, wherein the stud is provided with a T-screw in order to fix the driving gear to the elongated hole. By releasing the T-screw, the driving gear can be quickly moved in accordance with the primary arrangements of bearings of the rollers. If the driving gear of the spindle is pinched against the elongated hole by means of the T-screw, fine-tuning of the spindle can be carried out.

An additional configuration of the invention provides for the spindle mechanism of the rod assembly which carries the limit stop of the journal of the screen roller such that it can be coupled to the rod assembly of the limit stop for the printing roller. In this configuration, the printing roller and screen roller can be adjusted together, relative to the counterpressure roller, if the driving gear of the spindle drive of the limit stop for the printing roller is released from the hinged plate. If the driving gear of the spindle of the rod assembly of the limit stop for the printing roller is connected to the plate or is pinched against the same, fine-tuning can be done by means of the spindle drives and, in fact, this limit stop as well as the limit stop for the screen roller can be fine-tuned by means of the spindle drive for the rod assembly of the limit stop for the printing roller, wherein, in addition, a fine-tuning of only the limit stop for the screen roller can be done by means of the spindle drive of the rod assembly carrying the limit stop of the screen roller.

A clamping device can be provided for coupling, which clamping device features two clamping jaws, and the T-screw for bracing the clamping jaws of this clamping device freely passes through the elongated hole.

The abutments can be guided in guide mechanisms of the plate and travel by means of driving mechanisms. In order to be able to quickly conduct the abutments to their bracing position and out of the same, the driving mechanisms are advantageously composed of pneumatic cylinders.

For a multicolor rotary printing press, several mounting devices for the releasable thrust bearings can be arranged on one plate.

It is advantageous to use limits stops to limit the position of the plate for swinging the same into or out of the operating position.

The plate can be connected to the rolling stand by means of two hinged joints, in the manner of a door. An additional configuration of the invention provides the hinged joints with an eccentric characteristic, such that the swinging movement is combined with a translational movement which moves the limit stop away from the journal. This configuration ensures that the limit stops cannot strike against and damage the journals at the ends of the rollers or the bearings placed on the same.

BRIEF DESCRIPTION OF THE DRAWINGS

One embodiment of the invention is more closely explained in the following with the aid of the figures. Shown are FIG. 1 A side view of the auxiliary arrangement of bearings of the free ends of the printing and screen rollers with the part of the swinging plate for carrying these arrangements of bearings cut away, FIG. 2 An enlarged representation of the auxiliary arrangements of bearings of FIG. 1.

DETAILED DESCRIPTION OF THE PREFERRED EMBODIMENTS

Figure 3:
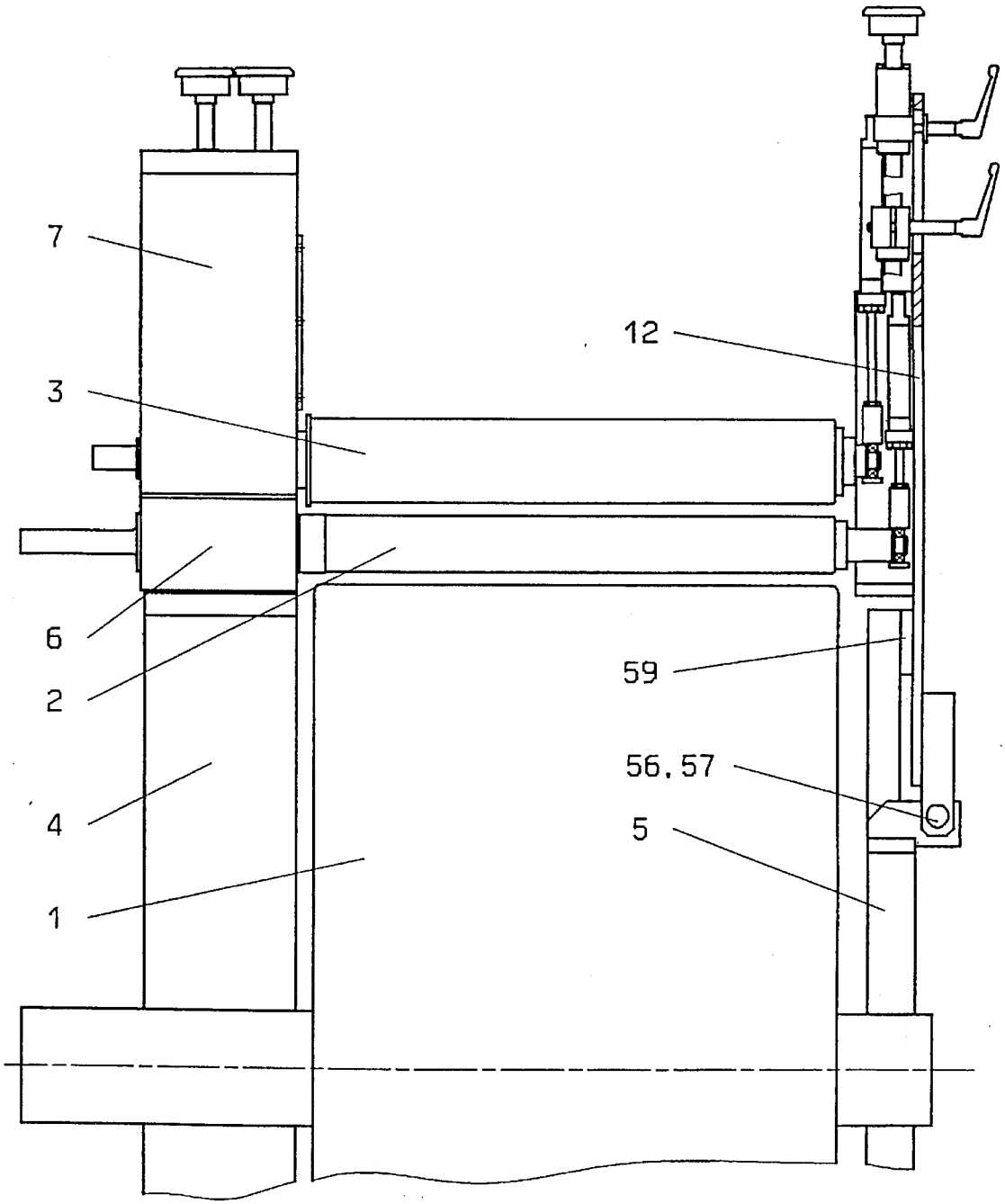
FIG. 3 A top view of the counterpressure cylinder and printing roller and of the screen roller with arrangements of bearings.

As is evident from FIG. 3, the counterpressure cylinder (1) common to all printing groups is carried such that it can rotate in the rolling stand of the printing press, which rolling stand possesses a thicker, side rolling stand (4) and a thinner, side rolling stand (5). In the thicker, side rolling stand (4), the swivel fixed pivot brackets (6, 7), which cantilever the printing roller (2) and screen roller (3), are carried such that they can travel on slide arrangements, with the swivel fixed pivot bracket (6) for the printing roller (2) being arranged on a slide which travels on guide mechanisms of the side rolling stand (4) and the swivel fixed pivot bracket (7) for the screen roller (3) being arranged on guide mechanisms of the slide carrying the swivel fixed pivot bracket (6).

The configuration of the swivel fixed pivot brackets (6, 7) and the slides carrying the former and of the slide mechanisms and the mechanisms for quick adjustment and fine-tuning of the swivel fixed pivot brackets are known, e.g., from DE-GM 9,208,023 and 9,208,449 and DE 4,306,711 A1 to which reference is made for a closer representation of the slidable arrangements of bearings.

Figure 4:
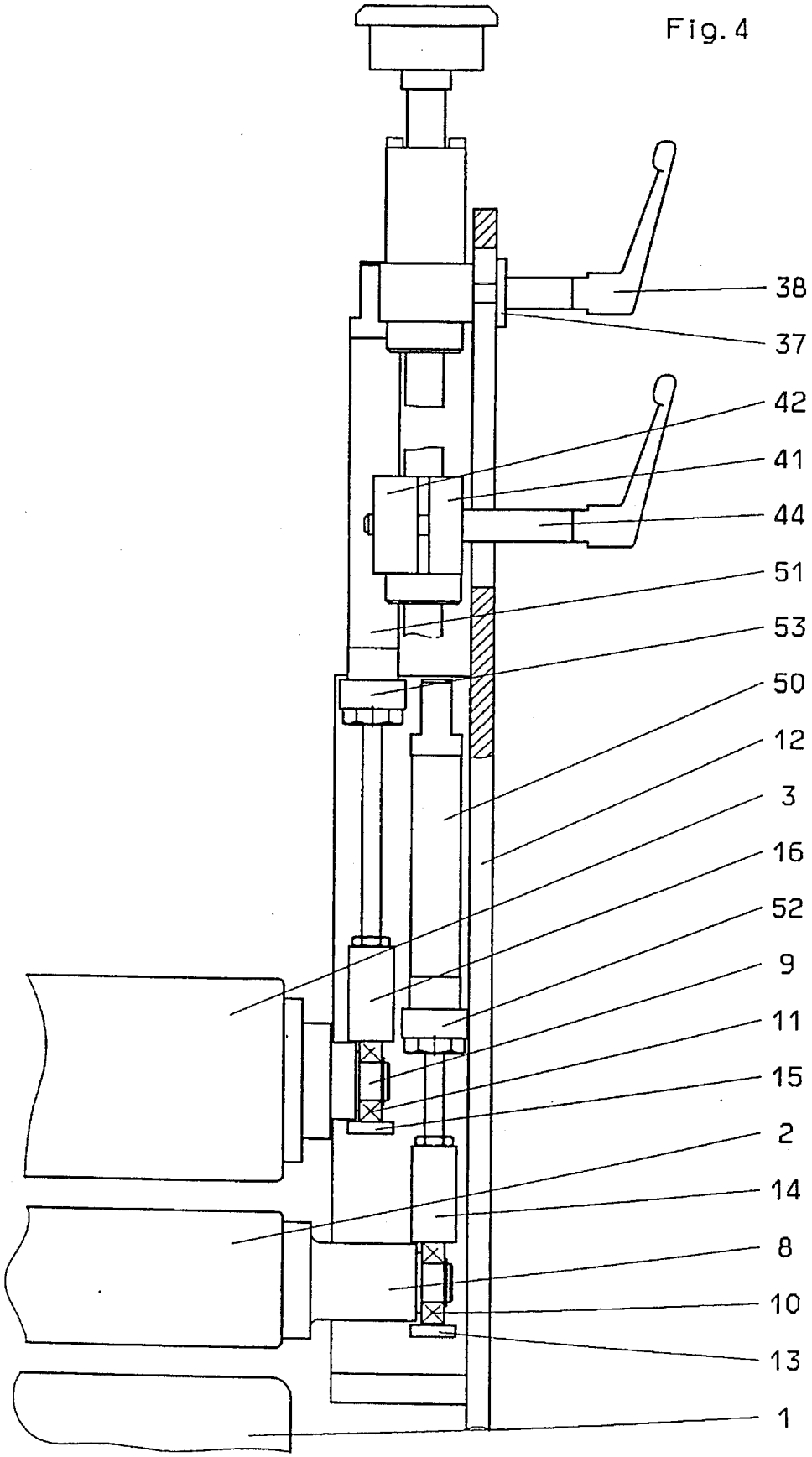
FIG. 4 An enlarged representation of the auxiliary arrangements of bearings, evident from FIG. 3, of the free ends of the rollers.

As is most evident in FIG. 4, antifriction bearings (10, 11) are placed on the journals (8, 9) of the free ends of the cantilevered rollers (2, 3).

When the door-like plate (12) is swung to the operating position in which it holds the auxiliary bearings, the antifriction beating (10) of the printing roller (2) is clamped between a limit stop (13) and an abutment (14).

In the operating position, the antifriction beating (11) of the screen roller (3) is clamped between the limit stop (15) and the abutment (16).

The limit stop (13), in the form of a terminal-end elbow, is fastened to a rod assembly (17), which is guided in a guide mechanism (18), in a manner permitting longitudinal movement, but not rotation.

The limit stop (15) is fastened to the end of the rod assembly (19) guided in the same manner, in a guide mechanism (20) which permits longitudinal movement, but not rotation. The guide mechanisms (18, 20) are fastened, in the manner represented, to the spans (21, 22), parallel to each other, of a rectangular frame, which spans are connected to each other by means of crossbars (23, 24). In the embodiment represented, as is evident from FIG. 1, four frames (21–24) are fastened by means of studs (27) in eight holes (26) respectively in the plate (12) which can be swung in the manner of a door. The embodiment represented consequently exhibits an eight-color rotary printing press.

The rod assembly (17) can be adjusted by means of a spindle drive in the longitudinal direction of the guide mechanism (18). The spindle drive is composed of a driving gear (30), not more closely represented, containing a spindle nut and a spindle which rotates by means of a control knob (31), such that by rotating the knob (31) the rod assembly (17) can be adjusted relative to the driving gear (30).

The rod assembly (19) of the limit stop (15) is correspondingly provided with a driving gear (33), which likewise is composed of a spindle and a spindle nut, which can be rotated relative to each other by means of a knob (34). If the rod assemblies (17, 19) are retained in a manner preventing rotation in the driving gears (30, 33), the guide mechanisms (18, 20) can also be composed, e.g., of ball-type nipples, since the latter do not need to additionally prevent rotation of the rod assemblies.

The driving gear (30) is provided with a threaded hole (36), in which is screwed a T-screw (38) provided with an abutment plate or collar (37), which T-screw passes though an elongated hole (39) of the plate (12). By controlling the T-screw (38), by means of the handle of the same, the driving gear (30) can consequently be clamped to the edge of the elongated hole (39).

Figure 2:
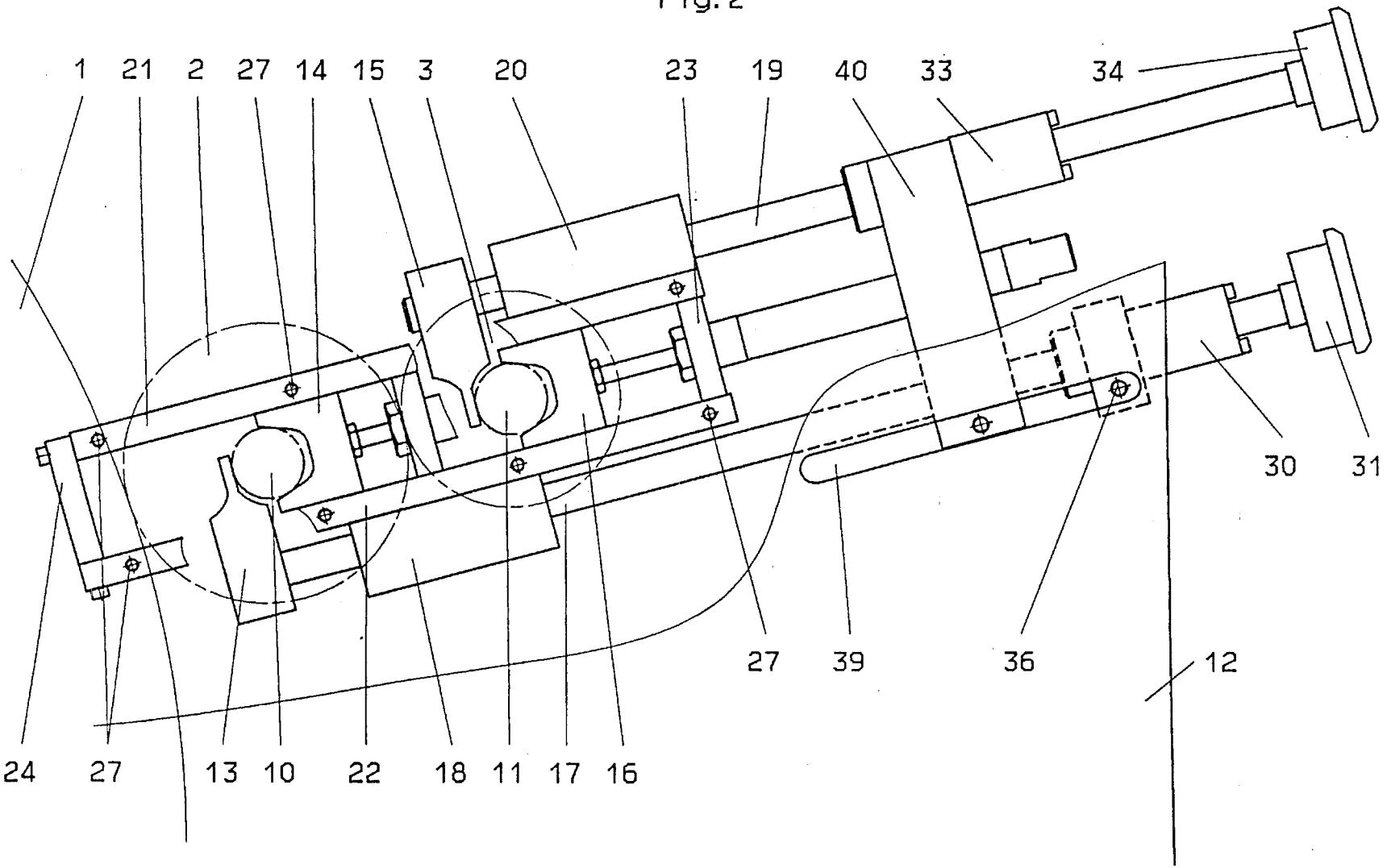

The driving gear (33) for the rod assembly (19) of the limit stop (15) of the screen roller is provided with a clamping device (40), which features two jaws (41, 42), which are evident from FIGS. 3 and 4, in a position rotated by 180°. The rod assembly (17) which carries the limit stop (13) is mounted between the jaws (41, 42), and the clamping device (40) can be clamped to the rod assembly (17) by means of a T-screw (44) provided with a handle, which T-screw can be screwed into a threaded hole of jaw (42) and, having an annular collar, is supported by a through-hole of the jaw (41). The T-screw (44) passes through the elongated hole (39), in the manner evident from FIG. 2, in such a way that the former moves freely in the latter.

If the driving gear (33) of the spindle drive for the rod assembly (19) is clamped, with the clamping device (40) to the rod assembly (17), then after releasing the locking screw (38), the limit stops (13, 15) are freely movable in the longitudinal direction of the guide mechanisms (18, 20) and of the elongated hole (39). If the T-screw (44) is released, the clamping device (40) can be moved relative to the rod assembly (17).

If the driving gear (33) is clamped with the clamping device (40) to the rod assembly (17) and if, in addition, the locking screw (38) is tightened down such that the driving gear (30) is fixed to the elongated hole (39), then fine-tuning of the limit stops (13, 15) can be done by means of the control knobs (31, 34).

The antifriction bearings (10, 11) which are placed on the journals of the free ends of the rollers (2, 3), are placed under tension, by means of the traveling abutments (14, 16), against the limit stops (13, 15). In order to be able to undertake this bracing easily and quickly, the abutments (14, 16) travel by means of the piston rods of pneumatic cylinders (50, 51). The abutments (14, 16) travel in vertical planes, laterally displaced with respect to each other, in guide mechanisms which are arranged on the spans (21, 22) of the frame screwed to the plate (12). The pneumatic cylinders (50, 51) are fastened to mounting devices (52, 53) which are connected to the frames (21–24).

If, for example, the sleeve of the printing roller is to be exchanged for a sleeve with different blocks in order to execute a new printing order, the abutments are moved away from the antifriction bearings by means of a corresponding control of the pneumatic cylinders (50, 51), such that the plate (12) can be swung out of the operating position. The T-screw (38) can also be released beforehand such that the limit stops (13, 15) can be pushed away from the bearings (10, 11) by moving the driving gear (30) in the direction of the counterpressure cylinder (1).

Figure 1:
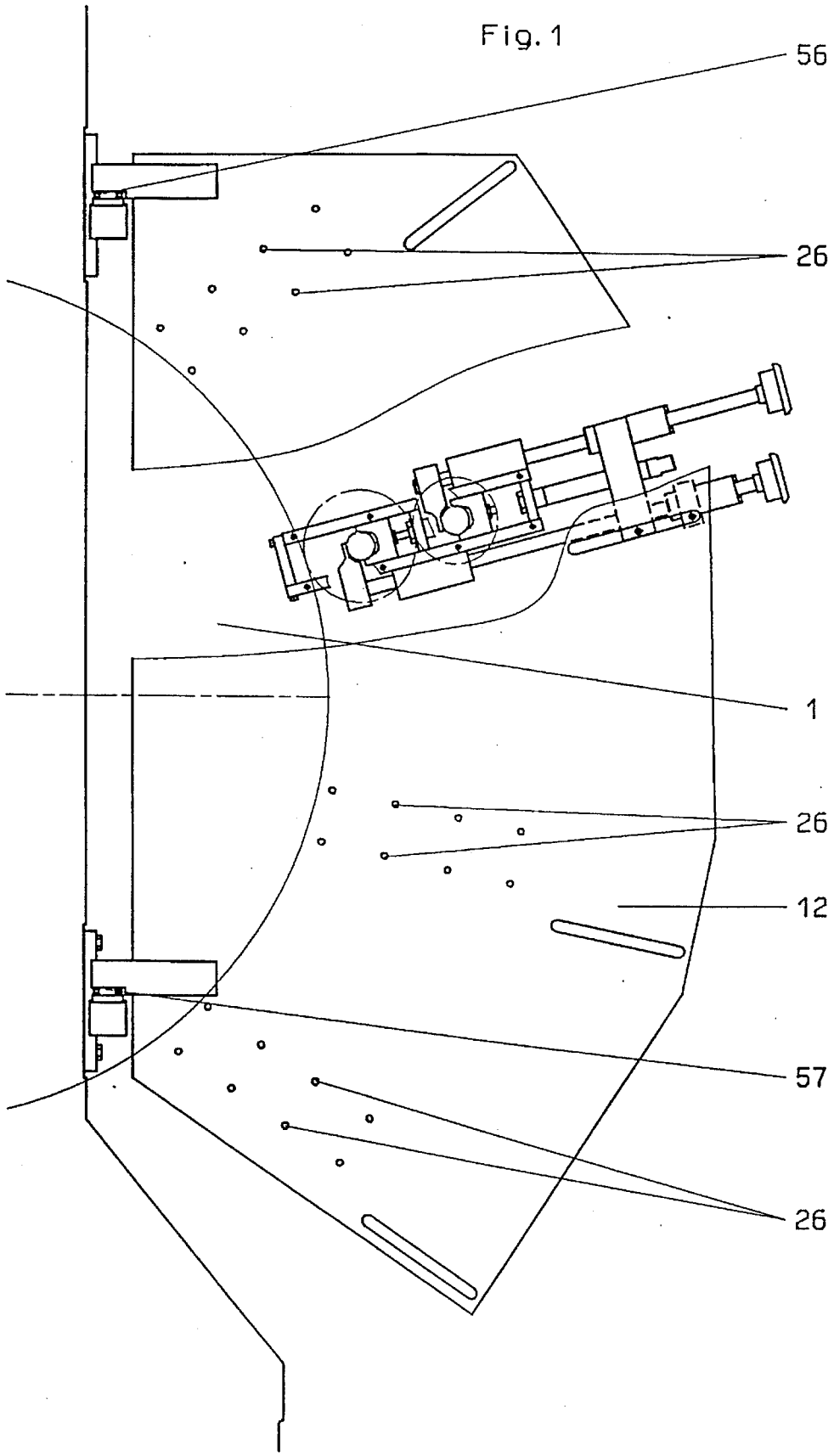

As is evident from FIG. 1, the plate (12) which carries four auxiliary arrangements of bearings is connected in an articulated manner, by means of two hinges (56, 57), to the narrower, side rolling stand (5). In this regard, an eccentric beating mounting of the swiveling hinge is provided in such a way that the swinging movement of the plate (12), when opening, is combined with a translational movement in the direction of the counterpressure cylinder (1), ensuring in all cases that when swinging the door-like plate to the open position, the limit stops (13, 15) are moved away from the bearings (10, 11).

When swung to the operating position, the plate (12) strikes against abutments (59) which are arranged on an extension of the side rolling stand (5).

What is claimed is:

1. A flexographic printing press, comprising at least one counterpressure cylinder and at least one printing roller cantilevered at one end in a rolling stand and at least one inking roller or screen roller of an inking system cantilevered at one end in the rolling stand, where bearings of the printing roller and screen roller travel, in guide mechanisms, relative to the counterpressure cylinder, characterized in that a carrier or plate (12) is coupled to the rolling stand (4, 5), which plates is provided with bearings in order to accommodate journals of free ends of the printing and screen rollers (2, 3) or are provided with receivers for bearings (10, 11) placed on journals (8, 9) and in that the plate (12) can be swung to either a retracted position, in which the cantilevered rollers (2, 3) are freely accessible, or to a operating position, where the journals (8, 9) of the free ends of the rollers (2, 3) are carried by the plate (12).

2. The printing press of claim 1, wherein the journals (8, 9) of the free ends of the cantilevered rollers (2, 3), or the bearings (10, 11) placed on the same are held between one limit stop (13, 15) respectively of the plate (12) and one movable abutment (14, 16) respectively which travels toward the limit stop.

3. The printing press of claim 2, wherein each of the limit stops (13, 15) are adjustable parallel to slide mechanisms of a primary arrangement of bearings of the rollers (2, 3).

4. The printing press of claim 2, wherein each of the limit stops (13, 15) is fastened to a rod assembly (17, 19), movable in guide mechanisms (18, 20), and each is provided with a fine-tuning control device.

5. The printing press of claim 4, wherein the fine-tuning control device comprises a spindle drive.

6. The printing press of claim 5, wherein a driving gear (30, 33) of the spindle drive can be adjusted on the plate (12) in a longitudinal direction of the spindle and can be fixed to the plate (12).

7. The printing press of claim 5, wherein the plate (12) is provided with an elongated hole (39) parallel to the spindle or to a rod assembly (17, 19), through which a stud (38) passes which carries a driving gear (30) and in that the stud is provided with a T-screw for fixing the driving gear (30) to the elongated hole (39).

8. The printing press of claim 7, wherein a spindle mechanism of the rod assembly (19) carrying the limit stop (15) of the journal (9) of the screen roller (3) can be coupled to the rod assembly (17) for the printing roller (2).

9. The printing press of claim 8, wherein a clamping device (40) which features two clamping jaws (41, 42) is provided for coupling, and the T-screw (44) which puts the clamping jaws of the former under tension freely passes through the elongated hole (39).

10. The printing press of claim 2, wherein the abutments (14, 16) travel in guide mechanisms of the plate (12) and by means of driving mechanisms.

11. The printing press of claim 10, wherein the driving mechanisms comprise pneumatic cylinders (50, 51).

12. The printing press of claim 1, wherein, for a multicolor rotary printing press, several mounting devices for detachable thrust bearings are arranged on one plate (12).

13. The printing press of claim 1, wherein the operating position and the retracted position of the plate (12) are limited by means of limit stops (59).

14. The printing press of claim 2, wherein the plate (12) is connected to the rolling stand (5) by means of two hinged joints (56, 57).

15. The printing press of claim 14, wherein the hinged joints (56, 57) comprise an eccentric characteristic, wherein swinging movement is combined with a translatory movement which moves the limit stops (13, 15) away from the journals.

* * * * *